United States Patent [19]

Warner

[11] Patent Number: 4,991,235

[45] Date of Patent: Feb. 12, 1991

[54] NOVELTY HAT

[76] Inventor: Greg S. Warner, 302 N. Third, Bellevue, Iowa 52031

[21] Appl. No.: 410,274

[22] Filed: Sep. 21, 1989

[51] Int. Cl.[5] ..... A42B 1/22; A63H 33/00

[52] U.S. Cl. ..... 2/171.1; 2/183; 2/185 R; 2/187; 2/199; D2/248; D2/250; 446/27

[58] Field of Search ..... 2/171.1, 175, 185 B, 2/185 R, 181, 186, 187, 188, 195, 196, 199, 209.1, DIG. 11, 183; D2/244, 248, 250, 263, 262, 511; 446/26, 27

[56] References Cited

U.S. PATENT DOCUMENTS

| | | | |
|---|---|---|---|
| D. 56,990 | 1/1921 | Place | 2/185 R |
| D. 247,333 | 2/1978 | Dane | D2/248 |
| D. 282,980 | 3/1986 | Hayton | D2/248 |
| 2,760,304 | 8/1956 | Chirco et al. | 2/185 R X |
| 3,263,235 | 8/1966 | Young | D2/244 X |
| 3,268,911 | 8/1966 | Cox | D2/244 X |
| 3,806,950 | 4/1974 | Spencer-Foote | 2/185 R X |
| 4,218,780 | 8/1980 | Growe et al. | 2/199 |
| 4,274,157 | 6/1981 | Boden | 2/181.4 |
| 4,545,313 | 10/1985 | Chiang | 2/199 X |
| 4,873,726 | 10/1979 | Tapia | 2/195 |

*Primary Examiner*—Allan N. Shoap
*Assistant Examiner*—Scott Cummings
*Attorney, Agent, or Firm*—Zarley McKee, Thomte, Voorhees & Sease

[57] ABSTRACT

The novelty hat of the present invention includes a hat shell formed in the shape of a three-dimensional object, such as an automobile, a boat, or a motorcycle. Within the hat shell is a hatband which is detachably connected by interlocking hooks and eyes mounted on the hatband and on the interior walls of the hat shell. The headband is adjustable in size so as to accommodate various head sizes.

5 Claims, 1 Drawing Sheet

NOVELTY HAT

BACKGROUND OF THE INVENTION

This invention relates to a novelty hat.

Many sporting events for vehicles, such as car races, boat races, and motorcycle races, are performed outdoors, often in the hot sun. It is therefore desirable to have a hat which provides satisfactory shade for the spectators.

Also, at many sporting events, spectators desire to identify with their preferred participant in the sporting events. For example, at car races, the spectators often desire to identify with the particular model of race car being driven by their favorite race driver.

Therefore, a primary object of the present invention is the provision of a new invention for a novelty hat.

A further object of the present invention is the provision of a novelty hat which will provide shade to the wearer from the sun, while at the same time permitting the wearer to identify with a particular model or brand of vehicle.

A further object of the present invention is the provision of a novelty hat which includes means for fitting the hat on the wearer in a plurality of positions, any one of which may be chosen to meet the wearer's desires.

A further object of the present invention is the provision of a novelty hat which is economical to manufacture, durable in use, and attractive in appearance.

SUMMARY OF THE INVENTION

The present invention utilizes a novelty hat which comprises a hat shell shaped in the form of a three-dimensional object such as a car, boat, motorcycle or other object. The shell is formed of plastic and is substantially rigid, and includes a top wall, a front wall, a rear wall, opposite sidewalls, and a bottom opening substantially larger than the person's head. The shell forms a head cavity therein.

Mounted within the head cavity is an elongated headband having first and second opposite ends which are adapted to be attached to one another in a plurality of adjustable positions to accommodate various hat sizes. The headband is secured to the interior of the hat shell by means of a pad of hook members and a pad of eye members. One of the pads is mounted or attached to the inside of the head cavity of the shell, and the other of the pads is connected to the headband. The hook members are detachably engaged with the eye members so as to detachably hold the headband within the head cavity of the hat shell. The hook members and eye members are conventionally identified under the trademark "Velcro".

Because of the Velcro attachment of the headband inside the hat shell, it is possible to adjust the angle of the headband relative to the hat shell so as to cause the hat to have the desired angle when worn by a person.

The hat shell can be formed into a vehicle which is a model of the wearer's preferred driver. It also could be modeled into the particular model of boat, motorcycle, or other vehicle with which the wearer wishes to identify.

The hat extends forwardly and rearwardly from the wearer's head so as to provide shade both to the wearer's face and forehead and also to the back of the wearer's head and neck. The hat shell also extends outwardly from both opposite sides of the wearer's head so as to provide additional shade to the sides of the wearer's head and the wearer's ears.

DESCRIPTION OF PREFERRED EMBODIMENT

Figure 1:
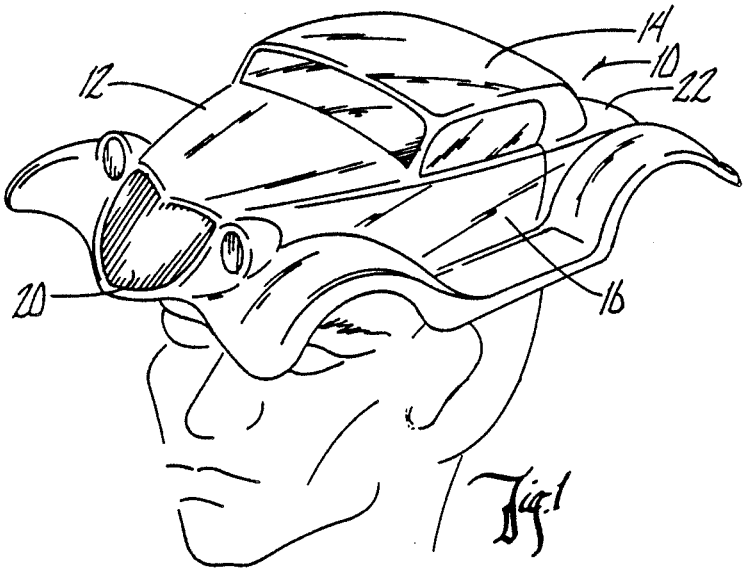
FIG. 1 is a perspective view of the present invention being worn on a person's head.

Referring to the drawings, the novelty hat of the present invention is generally designated by the numeral 10. Hat 10 comprises a shell 12 which is formed into the shape of a vehicle. While shell 12 is shown in the shape of an automobile, it could also be formed into the shape of a truck, boat, motorcycle, or other vehicle as desired. The shell comprises a top wall 14, opposite sidewalls 16, 18, a front wall 20, and a rear wall 22. The shell is hollow so as to form a head-receiving cavity 24 therein. The bottom of the shell is open so as to permit the insertion of the wearer's head into the head-receiving cavity 24.

Figure 2:
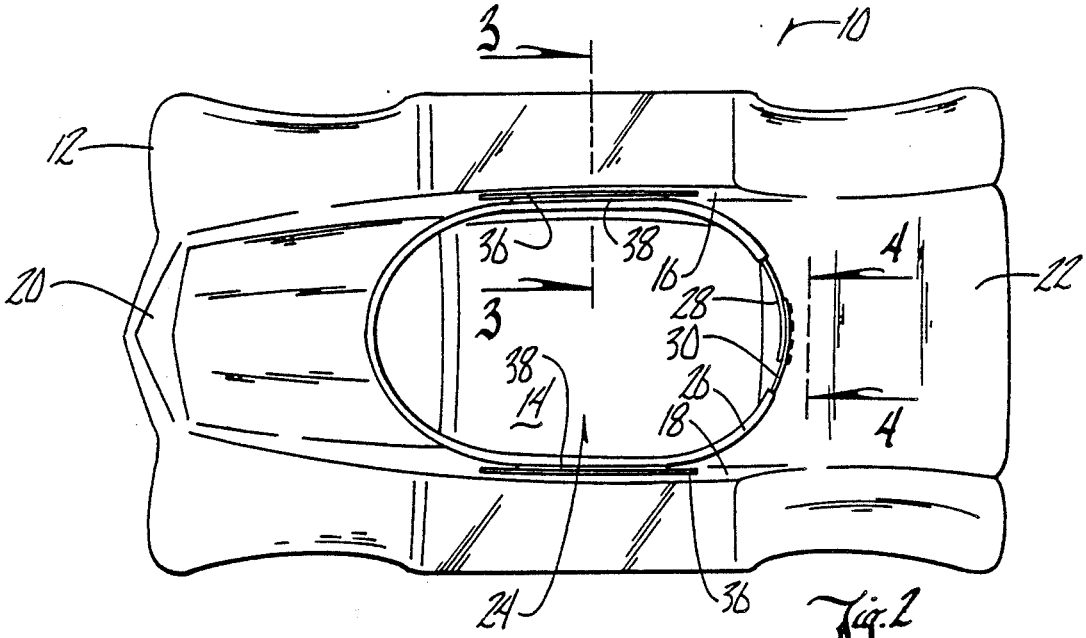
FIG. 2 is a bottom plan view of the present invention.
Figure 3:
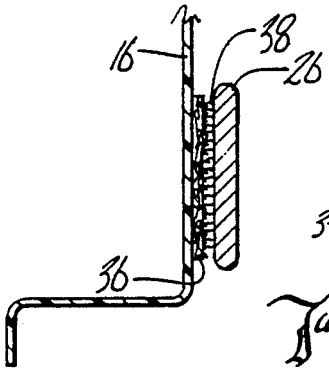
FIG. 3 is a sectional view taken along line 3—3 of FIG. 2.
Figure 4:
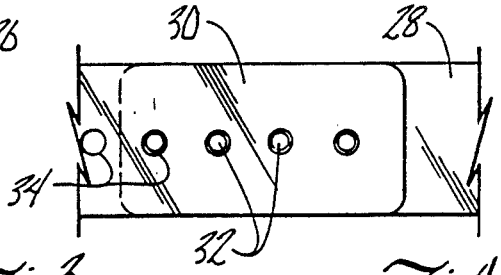
FIG. 4 is a detailed elevational view taken along line 4—4 of FIG. 2.

Mounted within head-receiving cavity 24 is an adjustable headband 26. Headband 26 has opposite ends 28, 30. End 30 includes a plurality of apertures 34 which are adapted to receive plastic pins 32 in the manner shown in FIGS. 2 and 4. The use of several apertures 34 and pins 32 permits the headband to be secured together in a plurality of configurations each of which corresponds to a different hat size.

Mounted to the interior of walls 16 and 18 are a pair of hooking pads 36, and mounted on the exterior of headband 26 are a plurality of eye pads 38. These pads are commercially available under the trademark "Velcro", and are adapted to engage one another to provide detachable securement of the headband 26 to the walls 16, 18 of shell 12. Because the hooking pads 36 and eye pads 28 are detachable from one another, it is possible for the wearer to adjust the angle of the shell 12 relative to the headband 26 so as to cause the shell to be worn at a particular angle as selected by the wearer.

The shell 12, when worn by a person as shown in FIG. 1, provides shade to the wearer's face, eyes, and forehead, to the back of the wearer's head and the wearer's neck, and to the side of the wearer's head and the wearer's ears. Furthermore, the hat provides the wearer with a display of the particular vehicle with which the player identifies. Thus, it can be seen that the device accomplishes at least all of its stated objectives.

I claim:

1. A novelty hat comprising:

a decorative, non-protective hat shell shaped in the form of a vehicle, said shell being formed of substantially rigid plastic and having a top wall, a front wall, a rear wall, opposite sidewalls, and a bottom opening substantially larger than a person's head, said shell forming a head cavity therein;

circular, adjustable headband having a variable circumference corresponding to a plurality of hat sizes;

headband securing means for detachably securing said headband to said hat shell within said head cavity, said headband securing means comprising a pair of hook member pads, having a plurality of hook members, attached to said opposite sidewalls of said hat shell within said head cavity, and a pair of eye member pads, having a plurality of eye members, attached to said headband in spaced relation to one another, said hook members of said pair of hook member pads retentively detachably engaging said eye members of said eye member pads for detachably retentively securing said headband within said hat shell; whereby the relative positions of said headband and said shell may be adjusted about an axis extending through said pair of hook member pads by detaching said pair of hook member pads from said pair of eye member pads, pivoting said shell relative to said headband about said axis, and reattaching said pair of hook member pads to said pair of eye member pads.

2. A novelty hat according to claim 1 wherein said securing means comprise hook members and eye members sold under the trademark "Velcro".

3. A novelty hat according to claim 1 wherein said hat shell is in the shape of a racing vehicle.

4. A novelty hat according to claim 1 wherein said headband corresponds to various hat sizes by means of having first and second opposite ends, adjustable fastening means on said first and second ends for detachably securing said first and second ends together in a plurality of selected positions to form said headband into an enclosed configuration.

5. A novelty hat according to claim 4 wherein said adjustable fastening means comprises of a plurality of apertures on one end of said headband and on equal number of plastic pins, spatially corresponding to said apertures, on the face of the second, opposite end; whereby the said apertures receive said plastic pins by means of compressing said plastic pins into said apertures.

* * * * *